US010494070B2

(12) United States Patent
McKinny, Jr.

(10) Patent No.: US 10,494,070 B2
(45) Date of Patent: Dec. 3, 2019

(54) PROPELLER ASSEMBLY

(71) Applicant: Charles S. McKinny, Jr., Corpus Christi, TX (US)

(72) Inventor: Charles S. McKinny, Jr., Corpus Christi, TX (US)

( * ) Notice: Subject to any disclaimer, the term of this patent is extended or adjusted under 35 U.S.C. 154(b) by 0 days.

(21) Appl. No.: 15/802,042

(22) Filed: Nov. 2, 2017

(65) Prior Publication Data

US 2019/0127035 A1 May 2, 2019

(51) Int. Cl.
*B63H 5/10* (2006.01)
*B63H 1/20* (2006.01)

(52) U.S. Cl.
CPC ..... *B63H 5/10* (2013.01); *B63H 1/20* (2013.01); *B63H 2005/106* (2013.01)

(58) Field of Classification Search
CPC ..... B63H 5/10; B63H 1/20; B63H 2005/103
USPC ..... 416/198 R
See application file for complete search history.

(56) References Cited

U.S. PATENT DOCUMENTS

| | | | | |
|---|---|---|---|---|
| 2,672,115 | A | 3/1954 | Conover | |
| 3,261,229 | A | 7/1966 | Thomas | |
| 3,470,961 | A | 10/1969 | Halsmer | |
| 3,922,997 | A | 12/1975 | Jameson | |
| 4,865,520 | A | 9/1989 | Hetzel | |
| 5,074,814 | A | 12/1991 | Hogg | |
| 5,310,371 | A * | 5/1994 | Iriono | B63H 5/10 440/52 |
| 5,494,466 | A | 2/1996 | Vernea | |
| 6,435,923 | B1 | 8/2002 | Ferguson | |
| 6,609,892 | B1 * | 8/2003 | Kreul | B63H 1/20 416/134 R |
| 6,899,576 | B2 | 5/2005 | Reuter | |
| 8,668,533 | B2 | 3/2014 | Rolla | |
| 2005/0064772 | A1 | 3/2005 | Wolters | |
| 2006/0263219 | A1 * | 11/2006 | Dean | B63H 1/20 416/134 R |
| 2011/0200445 | A1 * | 8/2011 | Takeda | F04D 29/38 416/223 R |
| 2015/0047543 | A1 | 2/2015 | Henriksen | |
| 2018/0003190 | A1 * | 1/2018 | Hamada | F04D 29/34 |

FOREIGN PATENT DOCUMENTS

| | | |
|---|---|---|
| DE | 2427245 | 12/1975 |
| EP | 1476352 | 11/2004 |
| WO | 1993000529 | 1/1993 |

* cited by examiner

*Primary Examiner* — Joseph J Dallo
*Assistant Examiner* — Yi-Kai Wang
(74) *Attorney, Agent, or Firm* — M. Susan Spiering; Ferrells, PLLC

(57) ABSTRACT

Disclosed herein is an inventive dual propeller assembly that can be manually or automatively assembled and includes a leading propeller, and a trailing propeller which are coaxially aligned and secured with a propeller shaft and a locking nut. Various embodiments are disclosed with and without interior grooves for alignment. In all embodiments, the two propellers are secured and aligned with a propeller shaft and locking nut assembly.

17 Claims, 17 Drawing Sheets

PROPELLER ASSEMBLY

CROSS REFERENCE TO RELATED APPLICATION(S)

This is a non-provisional, continuation in part, patent application based on co-pending U.S. Non Provisional application Ser. No. 15/632,036, filed Jun. 23, 2017, and, U.S. Provisional Patent Application Ser. No. 62/354,411 previously titled "Propeller Assembly", filed on Jun. 24, 2016, the priority of all which is hereby claimed and the disclosure of which is incorporated herein by reference in their entirety.

BACKGROUND

Field of the Invention

The present invention relates to a propulsion system for watercraft. More particularly, the present invention relates to an auxiliary propeller used in an axial arrangement with a standard propeller in the propulsion system.

Description of the Related Art

Propulsion systems are used to generate thrust to move a watercraft (also referred to herein as boat and defined as any vessel capable of moving through a water way with use of an engine and propeller). across or through water. Most of the watercrafts are propelled by mechanical systems that include an electric motor or an engine which powers a propeller. Boats often have one or two propellers (also called props) attached thereto for speed through the water. The propeller is generally secured to the rear portion of the electric or gas engine. To navigate the watercraft, the propeller is rotated in either a clockwise or counter-clockwise direction. Typically, once the boat is in shallow water, it will have difficulties pulling out to the deeper end. A boat or watercraft will displace water underneath its hull until the weight of the hull and the weight of the water displaced equal. This is typically called hole shot in boating terms since essentially a hole is formed under the boat. Sometimes the hole shot is also referred to as getting skeg out of the sand, acceleration from a standing position, or getting the boat from plane to acceleration. The hole shot is important information for determining proper hull/power combination. The faster a boat is able to achieve plane, the less fuel is consumed.

If the boat engine is started and the boater begins to navigate through the waterway at a closed throttle, generally the boat remains in the hole, i.e., the hole simply moves with the boat. The hull remains low, sitting in the water hole that was formed by the displacement of the boats' hull. To get out of the hole, a boater needs to move the boat fast enough so that it can exceed the speed of the hole that is moving under the boat and have enough power and torque to get the boat to climb the hole in a decent amount of time. In boating, a good hole shot is the ability to get up on plane ("getting out of the hole") and up to speed quickly from a stopped position. A poor hole shot would often be caused by the motor laboring and taking a long time to get up to speed (often because not properly propped for the load, or the boat is underpowered).

As an example, a high powered boat may have excellent top speed, but a poor hole shot, i.e., as the boat begins to move, the boats' hole continues to move and even perhaps increase in depth due to the changing angle of the boat. So when the boat begins to climb out of the hole there is less total hull sitting in the water, and the smaller hull, having the same weight will tend to settle deeper into the water. But now as the boat begins to move, the boat will gradually start climbing the steep edge of the hole. As the boat climbs higher, the edge of the hole gets less steep—hence you see the bow of the boat begin to drop lower. Finally as the boat is almost out of the hole, the boat will be near level and the boat will be moving fast enough to plane on top of the water, leaving the hole behind. Now, if you take the same high powered boat with a much lower pitch and possibly larger diameter propeller, the engine will be able to spin the larger diameter propeller more quickly, be able to more quickly accelerate the boat, and will more quickly climb out of the hole.

A lower pitched propeller, which may help in removing the boat from a hole shot, has the disadvantage of generally having a lower top speed motor (defined herein as the engine and propeller). This is because the lower pitched propeller cannot navigate (or screw) itself though the water, as easily as a higher pitched propeller.

The ability to get the boat on plane quickly is important for safety as much as any other reason. The quicker a boater can get the bow back down, the sooner s/he can see what is in front of them and avoid any unsafe situations, as well as keep themselves and other boat passengers dry.

Hole shot-related problems often occur during take-off of a boat, and most often in shallow versus deep water. Existing motors having single propellers typically perform poorly in shallow water since they cannot easily overcome the hole shot caused. To overcome the problems listed above, boaters have experimented with using multiple motors on the boat for increased speed, modifying the shape of the blades of the propeller (also called cupping), modifying the venting arrangement of the exhausts around the propeller to aerate the water surrounding it, or changing or enhancing the rotational speed of the propeller in existing motors. Other avenues considered for this problem were to modify the boat itself, such as in using trim tabs to keep the boat flat when coming out of a hole.

It is well known that a watercraft with dual propellers generates a stronger thrust force than the thrust generated by those equipped with a single propeller. Most known dual-propeller watercrafts require dual engines, each of which powers a corresponding propeller. Thus, having a dual propeller system is impractical for small and inexpensive watercrafts. There exists a need for an inexpensive, easy to produce, dual propeller system that uses a single engine to power the two propellers, thus reducing the expense and weight of the watercraft and generating a strong thrust force.

Art located includes:

U.S. Pat. No. 2,672,115 to Warren discloses a propulsion device with dual propellers.

U.S. Pat. No. 3,261,229 to Dallas et al. discloses a propulsion system for a boat.

U.S. Pat. No. 3,470,961 to Halsmer discloses a clutch for a twin engine aircraft with two propellers that are mounted coaxially on a single shaft.

U.S. Pat. No. 3,922,997 to Jameson discloses a marine power transmission system.

U.S. Pat. No. 4,865,520 to Robert et al. discloses a marine propeller with an addendum.

U.S. Pat. No. 5,074,814 to Alan discloses a self-contained outboard twin propeller adaptor.

U.S. Pat. No. 5,494,466 to Stefan discloses transmission of dual propellers driven by an inboard marine engine.

U.S. Pat. No. 6,435,923 to Ferguson discloses a two-speed transmission with reverse gearing for watercraft.

U.S. Pat. No. 6,899,576 to Reinhold et al. discloses a twin-propeller drive for watercraft.

U.S. Pat. No. 8,668,533 to Philip discloses a water jet-based propulsion system that utilizes more than one water jet outlet port to control selective application of power to the water jets, using a splitter gearbox, thereby improving the efficiency of the marine craft at low and high speeds.

U.S. Pub. No. 2005/0064772 to Karel et al. discloses a dual propeller drive for a ski boat.

U.S. Pub. No. 2015/0047543 to Thomas discloses propulsion arrangement for a marine vessel.

DE 2427245 to Rudolf teaches a drive system for a power glider that has twin propellers mounted on arms with belt drives that are foldable into the fuselage.

EP 1476352 to Graham discloses a marine counter-rotating shaft drive mechanism.

WO 1993/000529 A1 to Richard discloses a power transmission for use in marine inboards.

Most of the patents mentioned above disclose the use of propulsion systems that run two propellers with a single engine. Chain and sprocket arrangements are used to transfer power from the drive shaft of the engine to twin propeller shafts driving twin propellers. The propellers are arranged axially. However, the problem with most of the prior art systems is that the propellers wear out quickly and hole shot diminishes. Typically, dual propellers, which are coaxially aligned and driven in the same direction, are welded together. The welding of two propellers is time-consuming and labor-intensive and often shrinks the barrel of the propeller. This does not allow a smooth fit between the two propellers. This misalignment causes pulling and eventual burning of the propellers. The problem with welding is that the metals do not attach evenly, since the metal expands and shifts a little, resulting in the components not fitting snugly. Over time, use and vibration, the weld may sustain itself, but the propeller burns out.

In light of the foregoing, there exists a need for an easy to prepare, inexpensive, mechanism and/or a propeller to enhance the thrust force of a watercraft engine, improve the hole shot and maintain (or obtain) top speed of the watercraft.

SUMMARY

Disclosed herein is an easy and inexpensive method to increase power to a boat motor. While the problem to be solved was avoiding hole shot issues for boats in shallow water, the present invention has numerous benefits beyond the remedy for hole shot concerns. Further disclosed is an auxiliary propeller allowing the combining of two propellers in place on any given engine. This is not suitable for counter-rotating systems, but otherwise useful or suitable for all single output shafts. Still further disclosed is a unique coupling system to attach two propellers together without the need for a method of adhesively securing. Herein, adhesively securing is defined as welding, a chemical adhesive suitable for metal or plastic, or screws to hold the propellers in place or the like. Assembly of the dual propellers can be achieved manually or automatively (or by machine). The dual propeller system increases the thrust, and power of the boat. A perfect alignment is formed when the two propellers are combined, minimizing or eliminating the problems caused by welding or securing propellers with screws (problems such as pull of the metal, vibrations weakening the weld or attachment). A barrel or coupling device having a crown (grooves) was developed which fits securely in the interior section of the lead propeller, and allows for the combining of two propellers onto one engine. It was found that the present inventive device was able to move a boat out of shallow water using about half the RPMS (rotations per minute) than would normally be used. For exemplary purposes, most hulls require less than 2500-3000 RPMS to get on plane in shallow water conditions (shallow water defined herein as about 0"-12" of water, or preferably anything less than 6") with this device; with existing propeller systems it would require wide open throttle to get out of the hole.

An object of the present invention is to provide a method to enhance the power and thrust of an watercraft engine by combining two propellers; one becomes the trailing propeller that is secured and aligned coaxially with an existing or lead propeller. Broadly, the dual propeller assembly comprises a leading propeller and a trailing propeller, wherein the leading propeller comprises a cylindrical hub having an extended shaft portion on one end; mounting ring attached to the opposite end of the cylindrical hub which accepts a locking nut; the trailing propeller comprises a cylindrical hub and having a drive sleeve engaged with a propeller shaft wherein the propeller shaft secures the leading propeller and the trailing propeller with the locking nut.

In an alternate broad embodiment, disclosed is a dual propeller assembly comprising a trailing propeller that is secured to a leading propeller, the trailing propeller comprising a first cylindrical hub having a plurality of grooves on one end; a leading propeller designed to accept the plurality of grooves of the trailing propeller forming the dual propeller assembly, and the trailing and leading propeller secured together with a propeller shaft and locking nut which extends through the interior of the dual propeller assembly. The assembly may include port holes on the hub.

In an embodiment, the trailing propeller includes a first cylindrical hub (or barrel with grooves at its end, also referred to as a coupling system), a second cylindrical hub (accepting the barrel with grooves), and a conical profile there between. The first cylindrical hub or barrel includes a plurality of grooves on one end that are described and shown herein as rectangular in shape. While rectangular is a preferred shape, other shapes such as semi-circular, square-like, round over, V-groove, etc. are acceptable provided the grooves fit into the propeller assembly, or mate together. The shape allows the figure sliding over the lead propeller. The grooves are to be aligned with preferably 30° increments for timing purposes and are equidistant to each other. The second cylindrical hub includes a cylindrical mount ring that holds a drive sleeve. The cylindrical mount ring is attached to the second cylindrical hub or spline by using a set of radial mount ring flanges. The conical profile formed between the first cylindrical hub or barrel, and the second cylindrical hub allows smooth alignment of the trailing propeller with most if not all of current or existing propellers. The first cylindrical hub having the barrel with grooves is inserted in a hub (or interior portion) of the existing propeller. The outer diameter of the barrel is selected based on the inner diameter of the hub of the existing propeller. The trailing propeller can be effectively and consistently used with propellers made by any existing manufacturer.

The present invention comprises, in one embodiment, a barrel having grooves on one end, and ancillary parts to secure the propellers, all of which form an aligning system. The barrel fits into what becomes the trailing propeller which is coupled and aligned to a leading propeller without adhesively securing or welding. The leading propeller is any existing propeller. Thus, the coupling of the trailing propeller with the leading propeller is not time-consuming and less labor-intensive to combine than existing welding or attaching techniques. The absence of welding eliminates a potential misalignment of the trailing propeller and the leading propeller. Further, the trailing propeller may be attached to an engine irrespective of the engine manufacturer. Moreover, the trailing propeller and leading propeller do not counter-rotate with each other.

An alternate embodiment shown in FIG. 15, involves placing porting holes (1502) in the leading propeller to exhaust vapors and improve vapor displacement. At idle speeds, while the boat is in deep water, the vapor (porting) holes have been found to improve exhaust of the gas vapors. The holes create a turbulence which allow hole shot to increase under these conditions. Without the holes, the boat had a weaker hole shot in deep water (defined as greater than twelve inches).

In a further alternate embodiment, the invention comprises a barrel having no grooves on one end, with ancillary parts to secure the trailing and lead propellers, all of which likewise form an alignment system. Vapor holes may be added as desired to the lead propeller.

BRIEF DESCRIPTION OF THE DRAWINGS

The features of the present invention, which are believed to be novel, are set forth with particularity in the appended claims. Embodiments of the present invention will hereinafter be described in conjunction with the appended drawings provided to illustrate and not to limit the scope of the claims, wherein like designations denote like elements, and in which:

DETAILED DESCRIPTION OF THE EMBODIMENTS

Figure 1:
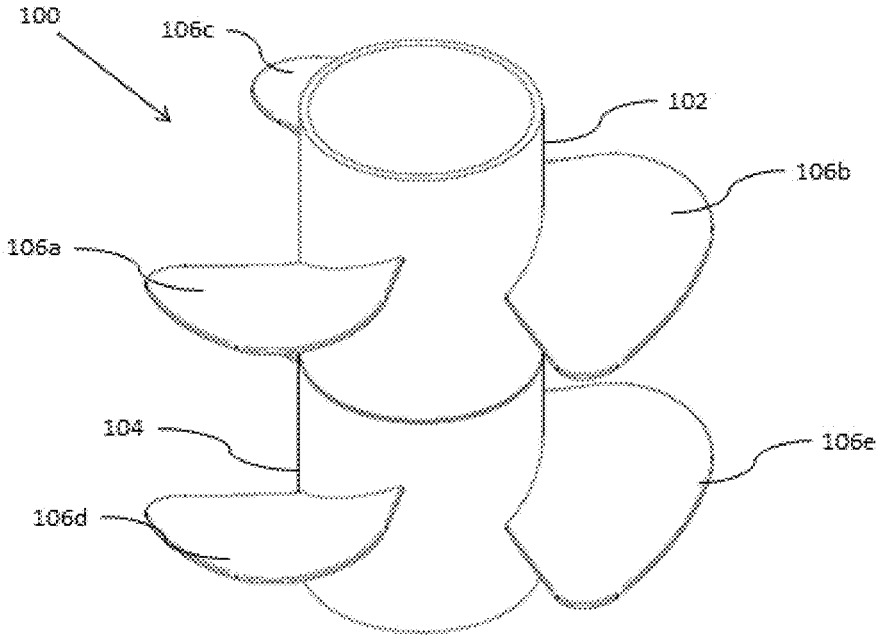
FIG. 1 shows an isometric view of a dual propeller assembly.

As used in the specification and claims, the singular forms "a", "an" and "the" include plural references, unless the context clearly dictates otherwise. For example, the term "an article" may include a plurality of articles unless the context clearly dictates otherwise.

Those with ordinary skill in the art will appreciate that the elements in the figures are illustrated for simplicity and clarity, and are not necessarily drawn to scale. For example, the dimensions of some of the elements in the figures may be exaggerated, relative to other elements, in order to improve an understanding of the invention.

There may be additional components described in the foregoing application that are not depicted in any of the described drawings. In the event such a component is described, but not depicted in a drawing, the absence of such a drawing should not be considered an omission of the design from the specification.

Before describing the present invention in detail, it should be observed that it utilizes a combination of system components, which constitutes an axial alignment of two propellers. Accordingly, the components and the method steps have been represented, showing only specific details that are pertinent for an understanding of the present invention, so as not to obscure the disclosure with details that will be readily apparent to those with ordinary skill in the art, having the benefit of the description herein.

As required, detailed embodiments of the present invention are disclosed herein. However, it should be understood that the disclosed embodiments are merely exemplary of the invention, which can be embodied in various forms. Therefore, the specific structural and functional details disclosed herein are not to be interpreted as limiting, but merely as a basis for the claims and as a representative basis for teaching one skilled in the art to variously employ the present invention in virtually any appropriately detailed structure. Further, the terms and phrases used herein are not intended to be limiting, but to provide an understandable description of the invention.

The present invention comprises a barrel having grooves and its ancillary parts. The barrel fits into a trailing propeller that is secured and aligned coaxially with a leading propeller to form a dual propeller assembly. In its simplest form, the barrel fits into the trailing propeller with its smooth end, and the grooves are secured into the leading propeller. The propeller assembly facilitates the movement of a watercraft when the propeller shaft of the leading propeller, which is connected to a driver shaft which is in turn connected to an engine of the watercraft, is rotated. For easy understanding, the forthcoming specification first describes various components and assembly of the leading propeller. The assembly can be configured manually without need for tools or welding. The components and assembly of the trailing propeller of the present invention are described, along with the complete propeller assembly of the leading propeller and the trailing propeller. The leading propeller includes an assembly of a cylindrical hub and multiple blades. The trailing propeller includes first and second cylindrical hubs, a conical profile, and multiple blades.

Referring now to FIG. 1, a propeller assembly 100 that includes a conventional leading propeller 102 and a trailing propeller 104 of the present invention, in accordance with an embodiment of the present invention is shown. The leading propeller 102 includes three blades 106*a*, 106*b*, and 106*c*. The trailing propeller 104 includes three blades 106*d*, 106*e*, and 106*f* (106*f* not shown). The trailing propeller 104 is secured and aligned coaxially with the leading propeller 102 to generate an increased thrust force especially useful for a boat in shallow water. A 3-blade prep is shown for exemplary purposes and any number of suitable blades may be used herein provided a coaxial alignment is achieved in the assembly.

Figure 2:
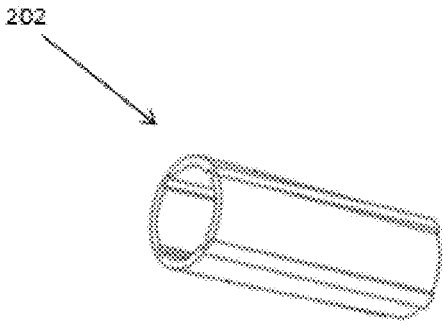
FIG. 2 shows an isometric view of a torsion bushing.

FIG. 2 illustrates an isometric view of a torsion bushing 202 that protects the engine of the watercraft. The torsion bushing 202 has a cylindrical body which is tapered along its length. The torsion bushing 202 thus has different diameters at the two ends thereof. Further, the torsion bushing 202 has multiple grooves on its inner surface. The torsion bushing 202 axially twists along the longitudinal axis in the event of an impact, such as the collision of the watercraft with an obstacle. To facilitate such axial twisting the torsion bushing 202 is made of a resilient material. An exemplary resilient material for the fabrication of the torsion bushing 202 is an elastomeric polymer, or heavy duty plastic (for example, polyethylene, polypropylene, ABS, and the like) provided it can withstand sheer and temperature forces it will be exposed to. It can also be made of suitable metals such as brass, stainless steel, cast iron, and the like. The torsion bushing can be manufactured, or purchased from a suitable manufacturers such as Evinrude, Mercury, or Honda (or other motor engines manufacturers). The present invention used a bushing from a Mercury engine.

Figure 3:
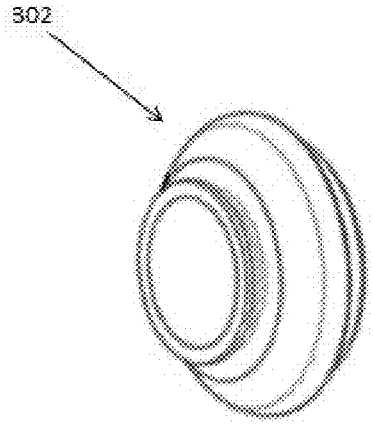
FIG. 3 shows an isometric view of a thrust washer.

FIG. 3 illustrates a thrust washer 302 (also referred to as washer) that prevents movement along the axis of a shaft. The thrust washer 302 is positioned towards the end of the propeller assembly 100 that is attached to the engine, to prevent damage to gears and other operating parts (not shown) of the outboard/inboard motor. The washer has a smooth beveled interior to allow for a secure fit of the components. The washer can be manufactured, or purchased from a suitable manufacturer. The present invention used a washer from the manufacturer Mercury.

Mercury brand hubs or boat parts in general (in particular spline or hub system) are relatively universal and fit most to all boats, including Evinrude brand boats. With perhaps slight adapting, Mercury brand parts can be made to work with all or most boat brands.

Figure 4A:
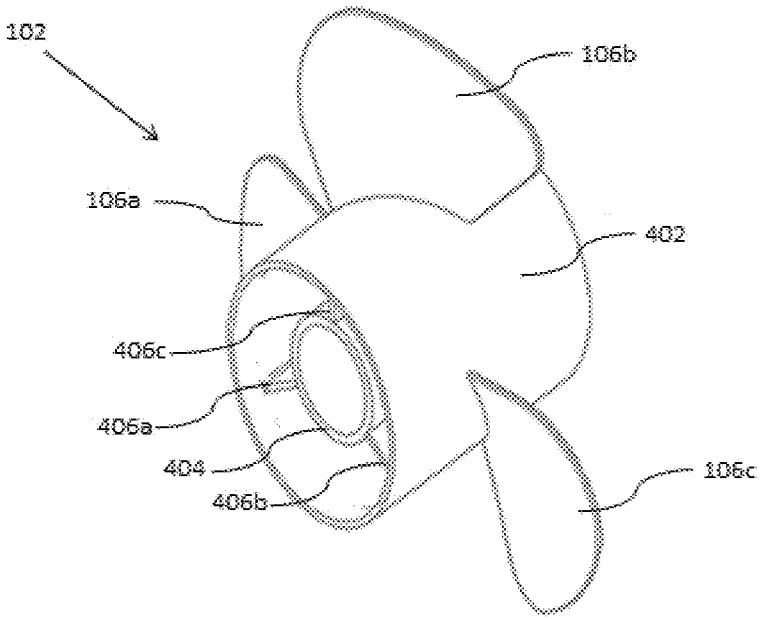
FIG. 4A shows an isometric view of a leading propeller of the propeller assembly of FIG. 1.
Figure 4B:
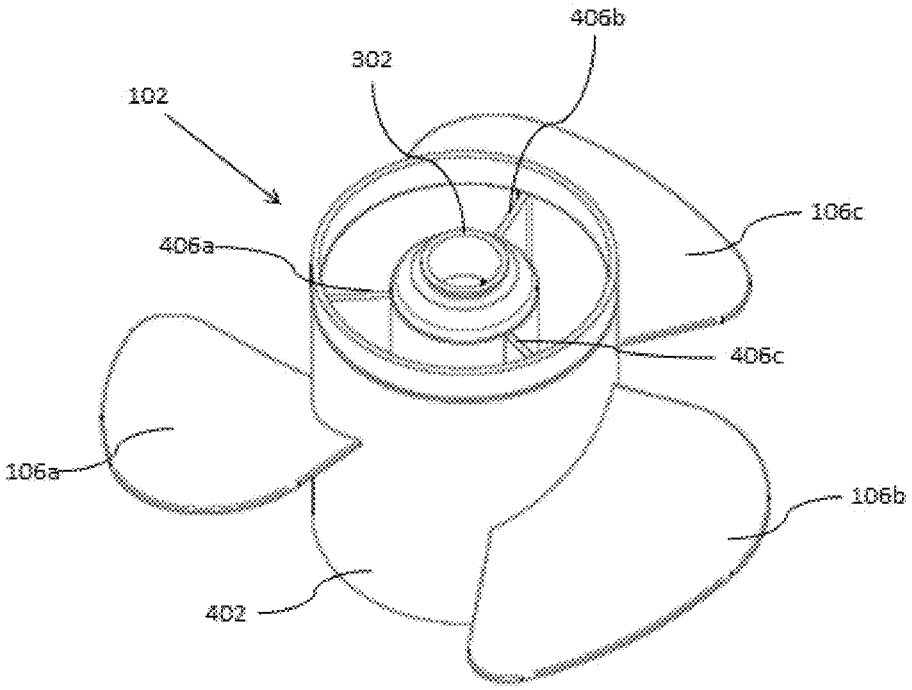
FIG. 4B shows an isometric view of the leading propeller with the torsion bushing and the thrust washer.

FIGS. 4A and 4B illustrate the leading propeller 102 of the propeller assembly 100. FIG. 4A illustrates the leading propeller 102 without the thrust washer 302. The leading propeller 102 includes a cylindrical hub 402, a cylindrical mount 404, and radial flanges 406*a*-406*c*. The blades 106*a*-106*c* extend from an outer surface of the cylindrical hub barrel 402. One end of the cylindrical mount 404 has a diameter equal to the larger diameter of the torsion bushing 202. The leading propeller 102 can be made of either aluminum, stainless steel or other similar materials. Further, FIG. 4B illustrates the leading propeller 102 with the thrust washer 302 attached at one end thereof. The thrust washer 302 has an opening that receives the propeller shaft and is tightly fitted in the cylindrical mount 404. The thrust washer 302 has a conical surface at the bottom thereof, which allows it to rest on the cylindrical mount 404 and top of the end of torsion bushing 202, which has a smaller diameter.

Figure 5:
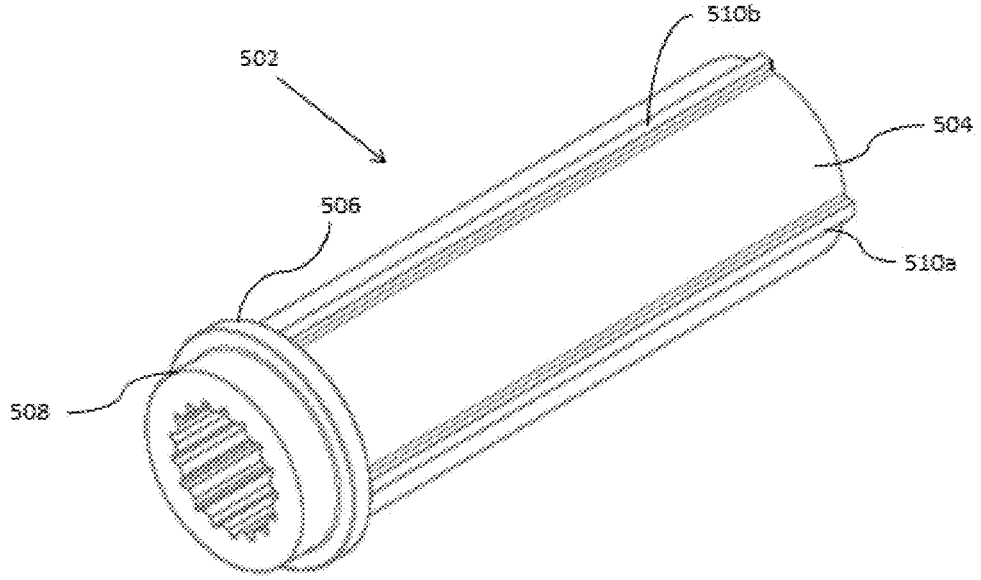
FIG. 5 shows an isometric view of a drive sleeve (or spline)

FIG. 5 illustrates a drive sleeve 502 that has a cylindrical body 504, a circular flange 506 and a cylindrical head 508. The drive sleeve 502 includes a first set of splines, two of which are shown in the FIGS. 5—510*a* and 510*b*—that extend along the cylindrical body 504. The circular flange 506 is positioned between the cylindrical body 504 and the cylindrical head 508. The cylindrical head 508 includes a second set of splines internally that assist the propeller shaft to pass through the drive sleeve 502. In one embodiment, the drive sleeve 502 is made of bronze but can also be made of stainless steel, iron, aluminum, elastomeric polymer or the like, or other suitable material which results in a solid sleeve. Further, the length of the cylindrical body 504 is more than that of a standard drive sleeve such that the trailing propeller 104 can be easily coupled to the leading propeller 102. Each groove of the torsion bushing 202 is arranged to receive the corresponding spline of the drive sleeve 502. The grooves are tapered to enable maximum torsional twisting and distribute stress evenly along the torsion bushing 202 in the event of a significant impact. The drive sleeve can be manufactured, or purchased from a suitable manufacturer such as Mercury. The present invention used a Mercury brand purchased sleeve.

Figure 6A:
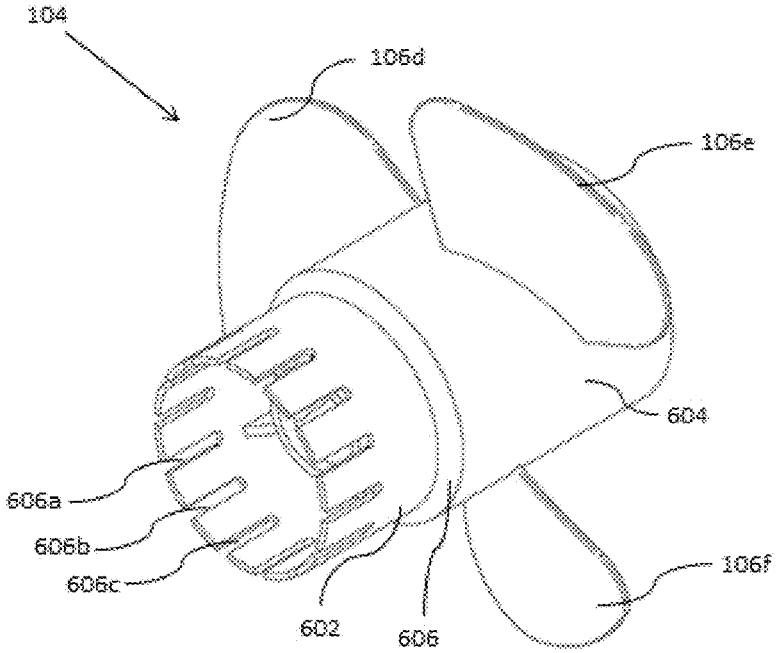
FIG. 6A shows an isometric view of a trailing propeller.
Figure 6B:
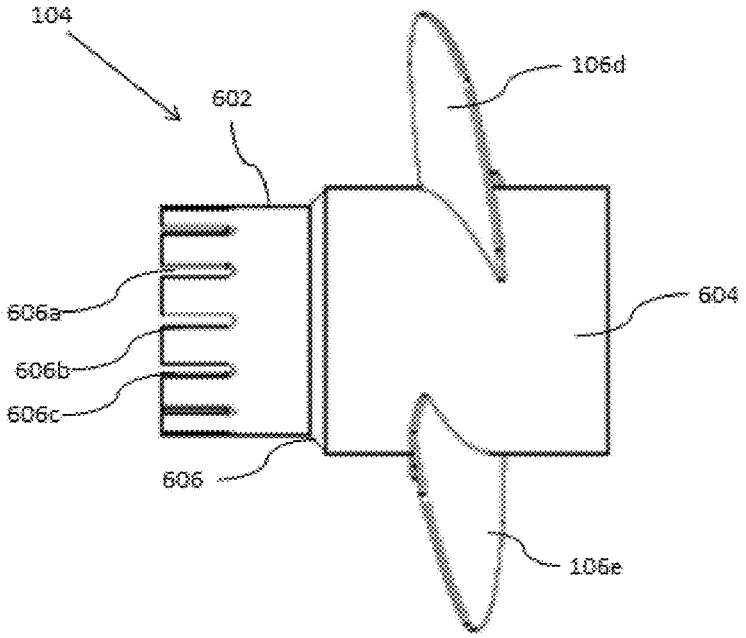
FIG. 6B shows a side view of the trailing propeller.

FIGS. 6A-6D illustrate the trailing propeller 104 of the dual propeller assembly 100 of FIG. 1. As shown in FIGS. 6A and 6B, the inventive barrel 602 is installed inside the trailing propeller 104. FIG. 6A includes a first cylindrical hub 602, a second cylindrical hub 604, and a conical profile 606 there between. The diameter of the first cylindrical hub 602 is less than that of the second cylindrical hub 604. The conical profile 606 is formed between the first cylindrical hub 602 and the second cylindrical hub 604. One end of the first cylindrical hub 602 includes multiple grooves 606, three of which are identified as 606*a*-606*c*. The grooves 606 are equally spaced and are locked onto the radial flanges 406*a*-406*c* of the leading propeller 102 (see FIG. 4B). There may be more or less than three grooves on the first cylindrical hub 602, generally 3-12 grooves on hub 602, without departing from the scope and spirit of the present invention.

The torsion hub holds the trailing propeller in place with a locking nut on the engine shaft. (See FIG. 6D).

Figure 6C:
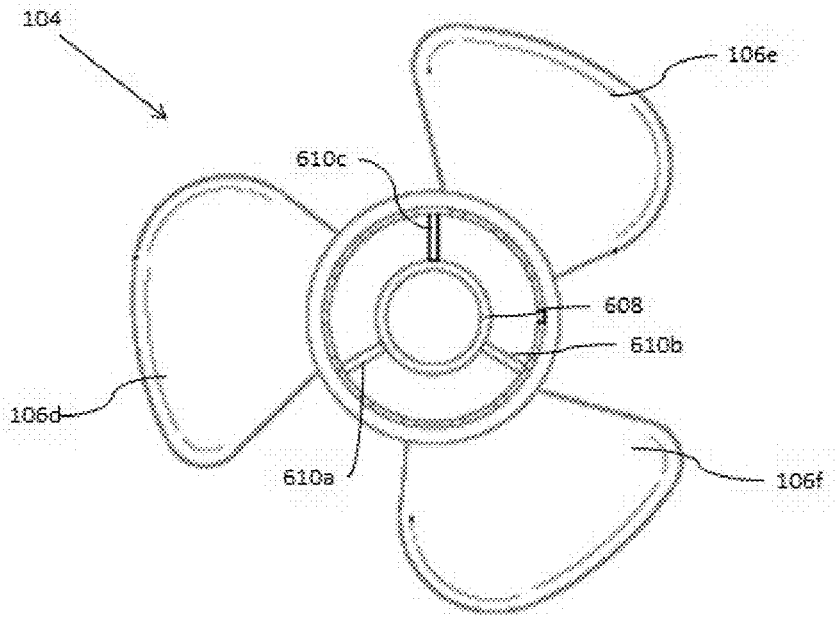
FIG. 6C shows a top view of the trailing propeller.

As shown in FIG. 6C, the trailing propeller 104 includes a cylindrical mount ring 608 with radial mount ring flanges 610*a*-610*c*. The radial mount ring flanges 610*a*-610*c* are attached to the internal surface of the second cylindrical hub 604 to affix the cylindrical mount ring 608 to the trailing propeller 104. The blades 106*d*-106*f* extend from the outer surface of the second cylindrical hub 604. It will be well understood to a person skilled in the art that the number of blades attached to the trailing propeller 104 may vary. While blades impact thrust, blades are not the primary scope of the present invention.

Cylindrical hub 602 fits inside of hub 402 to serve as the alignment system for the dual propeller assembly. The outer diameter of the hub 602 is sized so as to secure to the cylindrical hub barrel 402 of the leading propeller 102. The diameter can be modified (reduced or expanded) with a lathe to fit different propellers; or increased in diameter with rubber shims. For example in FIG. 6A, rubber shims may be placed and heat shrunk over the slots to alter the diameter. When the trailing propeller 104 is coupled to the leading propeller 102, the multiple grooves 606*a*-606*c* of the first cylindrical hub 602 are locked on the corresponding radial flanges 406*a*-406*c* of the leading propeller 102. The conical profile 606 allows the trailing propeller 104 to align with the tapered end of the leading propeller 102.

Figure 6D:
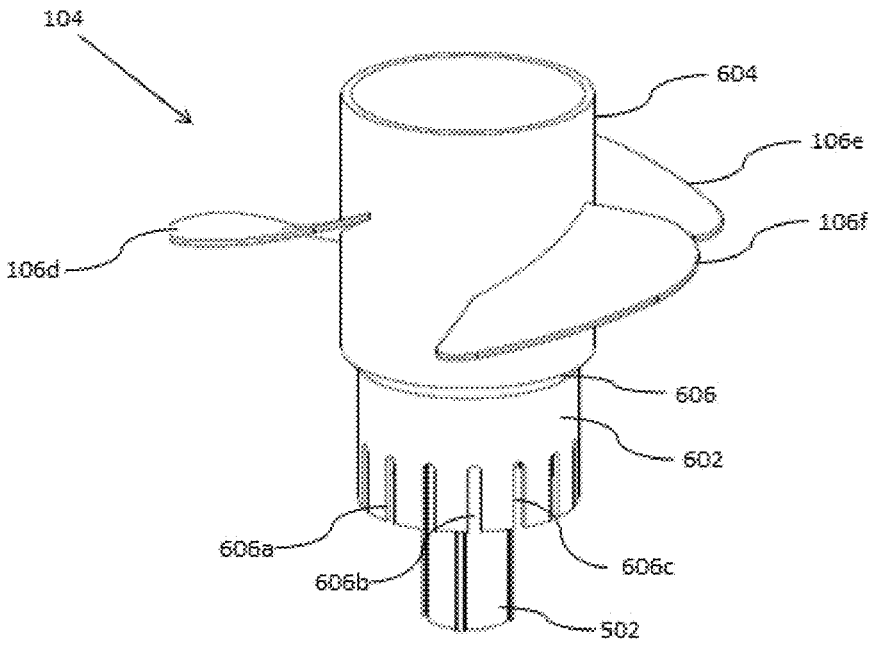
FIG. 6D shows an isometric view of the trailing propeller holding the drive sleeve.

In one embodiment and as shown herein, the grooves 606*a*-606*c* are rectangular in shape and symmetrical to ensure that the trailing propeller 104 is aligned comfortably with the leading propeller 102. To secure the trailing propeller 104 to the leading propeller 102, the drive sleeve 502 is inserted through the cylindrical mount ring 608 of the trailing propeller 104 into the leading propeller 102. The circular flange 506 of the drive sleeve 502 rests on the cylindrical mount ring 608. FIG. 6D illustrates that the trailing propeller 104 holds the drive sleeve 502. The torsion bushing 202 of the leading propeller 102 receives the cylindrical body 504 of the drive sleeve 502. The design of the trailing propeller 104 makes it easy to mechanically align it with the leading propeller 102. The alignment allows the leading and trailing propellers 102 and 104 to work together in sync. The assembly works best when the leading and trailing propellers are aligned.

The propeller shaft (FIG. 10, component 1012) has a tapered section for mating with the thrust washer 302, and a splined section for mating with the drive sleeve 502. Further, the propeller shaft includes a threaded section to receive the nut. To secure the propeller assembly 100 to the propeller shaft, the torsion bushing 202 is inserted into the cylindrical hub barrel 402. Further, the trailing propeller 104 is aligned with the leading propeller 102 by means of the grooves 606*a*-606*c* and the radial flanges 406*a*-406*c*. The drive sleeve 502 is inserted into the leading propeller 102 through the torsion bushing 104. The propeller assembly 100 is then affixed to the propeller shaft such that the propeller shaft is inserted with the drive sleeve 502. A washer is then affixed to the propeller shaft. Subsequently, the nut is placed on the propeller shaft so that the washer is tightly secured to the drive sleeve 502. Thus, propeller assembly 100 is secured to the propeller shaft.

The length of the propeller shaft is about the length of the dual prop assembly as the shaft together with the locking nut holds the assembly together. The dual assembly is then secured to a boat motor through the opposite end, or flat head end that does not lock to the nut, of the propeller shaft.

When the propeller shaft rotates, the torque, generated as a result of the rotation, is transferred to the drive sleeve 502, and then to the torsion bushing 202, followed by to the cylindrical hub barrel 402 of the leading propeller 102. Consequently, the torque is then transferred from the leading propeller 102 to the trailing propeller 104. The propeller assembly 100 is intact and ensures that the trailing propeller 104 spins synchronously with the leading propeller 102.

The leading propeller 102 and the trailing propeller 104 may be manufactured using either of an investment casting method or a machining method, or other methods known by those in the art. Further, the propellers for the assembly (102 and 104) may be made of materials such as composite, steel, aluminum, stainless steel, plastic, carbon fiber, all types of carbon, and fiberglass, the most preferred materials being stainless steel and aluminum. The first and second cylindrical hubs 602 and 604 of the trailing propeller 104 can be made of heavy-duty plastic if desired. Plastics such as described above. In another embodiment, the first and second cylindrical hubs 602 and 604 of the trailing propeller 104 can be made of aluminum. It has been found that either of the hubs or the entire assembly may be made of various materials provided they withstand the temperatures, pressures, and forces generated by the motor during use and withstand the environmental elements endured during use (e.g. salty water, muddy waters, water with contaminants of various types, and the like). The propellers may be made of the same or different materials, and the hub and the blades may be of the same or different materials. Likewise, the components can also be of the same or different materials. Composite materials may be in the form of reinforced plastics such as fiber reinforced polymers, metal composites or ceramic composites.

The trailing propeller 104 can be constructed in all dimensions to fit leading propellers of 5 horsepower (hp) to 400 hp in size. The trailing propeller 104 works using engines having a power range of about 115 hp to 400 hp. The propeller assembly 100 creates a stronger thrust force than a single propeller assembly. The use of the propeller assembly 100 is recommended for water of less than 12 inches, and has been found to be the most beneficial in extremely shallow water (of about or less than 6" deep) operations, as the propeller assembly provides a strong thrust.

For exemplary purposes, preferred dimensions of the trailing propeller 104 are: the diameter (about 3" to about 4.25") and length (about 2.5" to about 4") of the first cylindrical hub 602 are preferably about 4.16" and 3", respectively. The diameter of the second cylindrical hub 604 is about 3"-5" and preferably about 4.81". The length of the trailing propeller 104 is about 7"-10" with a preference for about 9-10 inches. The inner and outer diameters of the cylindrical mount ring 608 are about 1"-1.75" with a preference for about 1.65" to about 1.75" and 2"-3" with a preference for about 2.25 inches, respectively. The thickness of the first cylindrical hub 602 is about 0.10"-0.250" with a preference for a thickness of about 0.20".

The leading and trailing propellers 102 and 104 align axially and spin synchronously. This allows the propeller assembly 100 to maintain contact with the water effectively and hold more water mass on the leading and trailing propellers 102 and 104. This improves the hole shot. Further, the propeller assembly 100 enhances steering and handling of the watercraft. The trailing propeller 104 works with most if not all types of outboard and inboard motors. Moreover, the design of the trailing propeller 104 adapts to most if not all marine engines available. Experiments were conducted with a trailing propeller (104) having a standard V6 barrel. The dimensions of the trailing propeller 104 can be adjusted to fit most if not all outboard propellers.

It was found that the propeller assembly 100, with the leading and trailing propellers 102 and 104, retains water on the blades for twice as long as under normal conditions. This allows the blades to remain in contact with water, even though half of the propeller assembly 100 is outside of the water. The propeller assembly 100 allows outboards to get in very shallow water while doing the least amount of damage possible to the environment. It was also found that the propeller assembly 100 can operate completely above the running surface in a river with one-third to one-half of the blades on the water surface.

The alignment technique uses the geometry of the common outboard propeller to align the trailing propeller 104 mechanically. The trailing propeller 104 can be effectively and consistently used with propellers made by other manufacturers and it is accomplished with no loss of speed to the engine. The additional cupping of the blades, changing from 3 to 4 blades or 4 to 3 blades in the case of 4 stroke engines, enables additional rotations per minute (rpm) of the propeller assembly 100.

The barrel can be configured by adding slots and interior footing. The barrel may be modified to accept interchangeable blades allowing interchangeable pitch. This occurs by switching out the different pitch blades. An embodiment of this interchangeable system is use of polymeric composite materials, or aluminum, or stainless steel. The changing of materials allows for a less costly assembly for customers without a loss of performance. The user can experiment with pitch size for their boat, and or a single blade replacement for the propeller assembly, and determine what works best while the boat is in the water.

Another alternate embodiment is having a bevel on the lead barrel which allows a stop point for the trailing blades attached to the trailing barrel. This creates an assembly.

Figure 7:
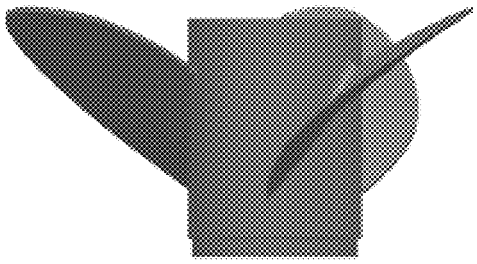
FIG. 7 shows a lead propeller to receive a trailing propeller.
Figure 8:
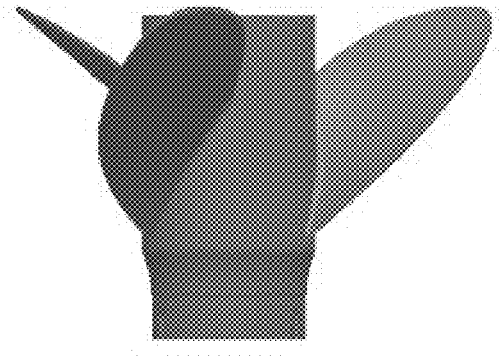
FIG. 8 shows a trailing propeller with a different pitch than shown in FIG. 7.

Collectively, FIGS. 7 and 8 illustrate that the invention can be modified for different boating needs of the user. This invention allows for modification of the pitch, blade and blade numbers, slots, and barrel to accurately select a correct configuration for a boating set-up. One of skill in the art will appreciate that the inventive propeller assembly herein, will consider factors such as boat engine, size, and gear ratio to ultimately create stern lift for the boat. The pitch of the blade can be varied, both front and rear, to accommodate different boating applications of the user. As the pitch varies, generally the position of the blade on the barrel will vary.

An alternate embodiment of the design involves removal of the grooves 606(*a*)-(*c*) et seq. and the bevel 606 associated with hub 604. It has been found that a design with no grooves, no outer barrel on the trail prop and having timing markers makes assembly and tuning of the dual unit easier for the user. The lack of a second barrel results in a lighter weight assembly, and retains thrust capabilities to move a boat out of hole shot position. The original embodiment described herein (having grooves) involves the trailing propeller being driven by the leading propeller. The modified embodiment (without grooves) involves the lead propeller driven by the trailing propeller.

Figure 9A:
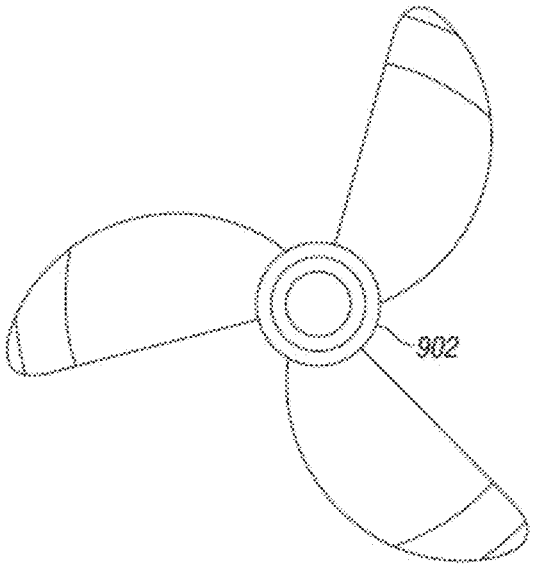
FIG. 9A represents a top view of the lead propeller illustrating the center portion of the prop.

FIG. 9A represents a top view of the lead propeller illustrating the center portion of the prop 902.

Figure 9B:
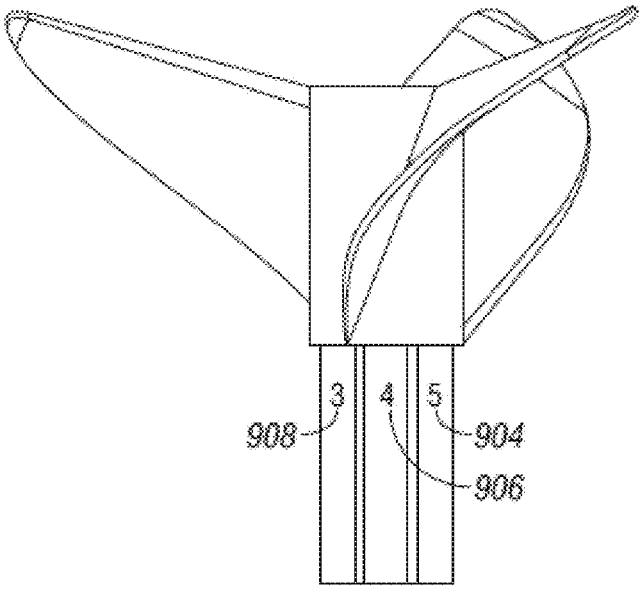
FIG. 9B illustrates a side view of the trialing prop illustrating the octagonal coupling and timing marks.

FIG. 9B illustrates a side view of the trialing prop 902 illustrating the octagonal coupling and timing marks 3, 4, and 5 respectively identified as 908, 906, and 904. No grooves are needed with this design and the shaft portion of 902 slides into the lead propeller. The shape of the trailing prop can be any geometric shape (eg. round, square, oval, etc) provided there is a corresponding shape to mate with for connection to the lead propeller. It can have anywhere from 3 or 4 to about 12 sides if desired with timing markers to correspond to a side.

Figure 10:
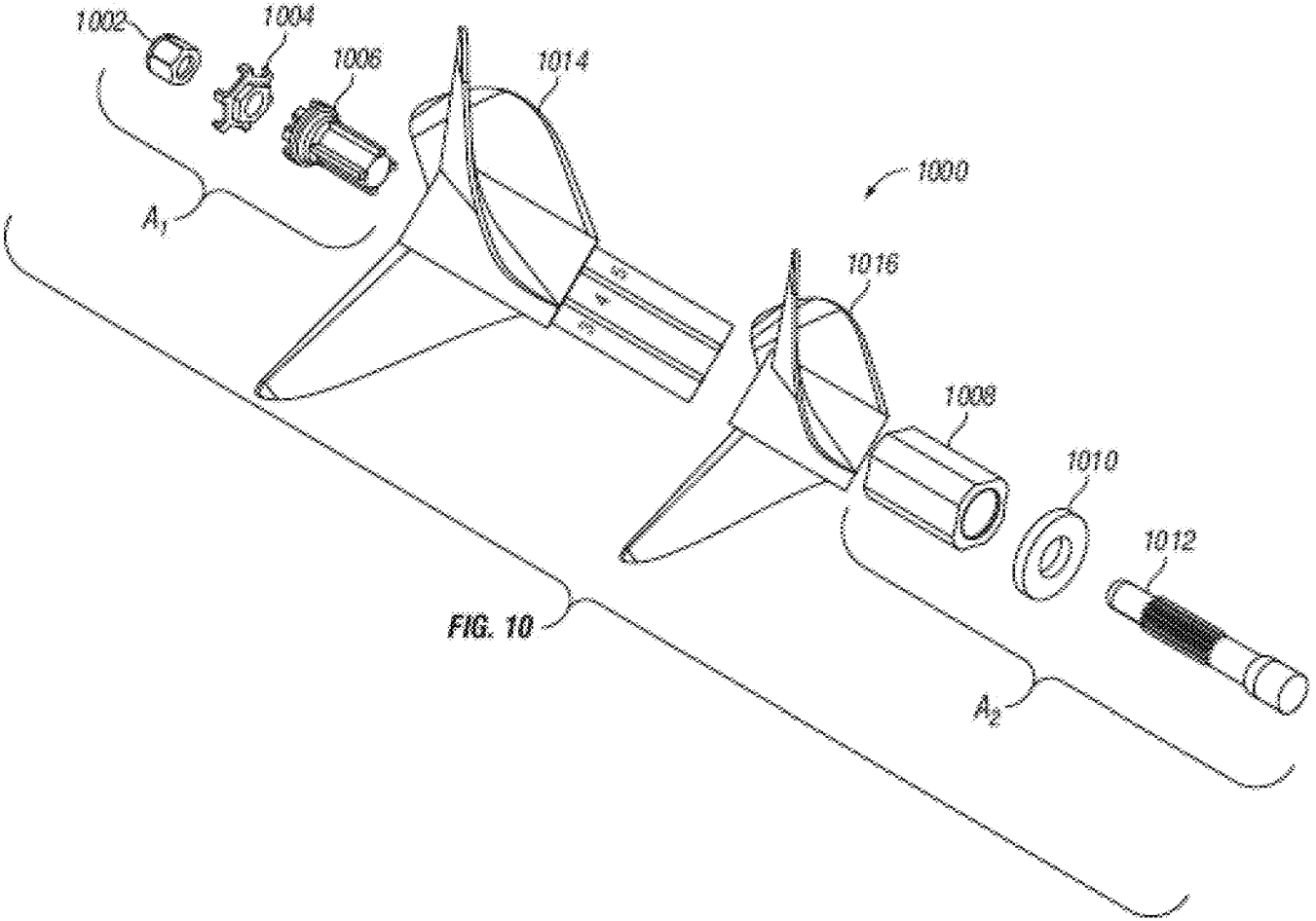
FIG. 10 illustrates an view of the assembly.

FIG. 10 illustrates a view of the alternate embodiment assembly 1000, having no exterior grooves on the trail propeller. FIG. 10 illustrates the assembly wherein the lock nut 1002, attaches to the tab washer 1004, which in turn are attached to the drive sleeve adapter 1006, and fit into the trail propeller 902. The base of the trail propeller 902 shows the timing markers which assist for setting up the alignment of the two propellers. The trail prop inserts fits inside the lead propeller 1016 (FIG. 10) which includes a drive sleeve 1008, a thrust washer 1010 and a propeller or output shaft 1012. Part 1006 matches and slides into part 1008. 1006 has splines that also attach to the output shaft 1012. 1006 also has locking sleeves so as cannot back out of the assembly. The washer 1010 seats into the sleeve 1008. The thrust washer may have a beveled surface to aid the alignment of the leading and trailing props. Depending on the engine for the boat, the thrust washer may have additional washers (flat circular standard style known and used in the industry, and herein used to align the components, or if the shaft is longer than the combined dual propellers) of up to 2, 3 or more. It is important that the thrust washer be seated properly for the proper alignment of the dual propellers to occur. The dual assembly connects to the boat motor through the propeller or output shaft. Here, the length of the output shaft is the length of the assembly from shaft to locking nut. The shaft and nut hold the assembly together.

Parts 1002, 1004, and 1006 collectively make up section A1 of the assembly 1000, while parts 1008, 1010, and 1012 make up collectively section A2 of the assembly 1000. A1 and A2 fit inside the trail prop and lead prop respectively. 1012 and 1014 respectively identify the entire propeller for the trail and lead props.

The lock nut 1002 is an important feature of the assembly as it must be tightly locked in place so as to secure and hold the assembly. The sizes of components of A1 and A2 can vary depending on the engine, horsepower, output shaft and manufacturer of the motor. A1 and A2 allow for tying all the parts together on the unit. It has been stated that the dual assembly may be pieced together manually or with automated assembly. The assembly differs in one aspect from traditional dual propellers, either embodiment disclosed, in that it does not have a weld between the lead and trailing propeller. When piecing together the present dual prop assembly tightening should be done to the manufacturer's specification. If under tight, in particular the locking nut, it may create failure of the output shaft and ultimately, failure of the dual prop assembly.

Relative to the manufacture of the dual assembly, while it is described in parts, it can also be manufactured with the spline inside the trail propeller, which can be pressed into the hub. Alternatively, one can manufacture the trail prop with the proper number of splines and the shaft diameter to accept the specific manufacturer's output shaft (e.g., Yamaha, Honda, Evinrude manufacturer, etc.). One can make the interior of the trailing and the leading prop to accept pressed-in hub assembly (e.g., after market pressed in hub). Generally one would use a manufacturer's specific hub (e.g., Evinrude, or Mercury hub). The trail and lead prop's can be manufactured with all the interior components except the output shaft and lock nut for placement on a user's motor. In this instance, the assembly would need to correspond to a manufacturer's motor specification.

Figure 11:
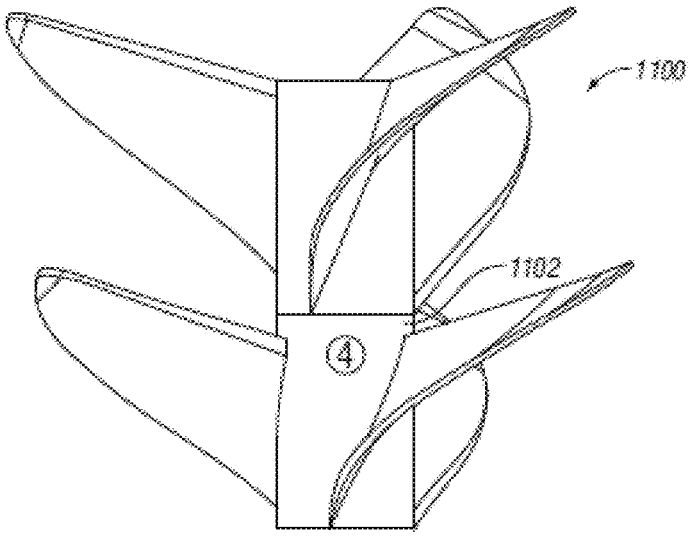
FIG. 11 illustrates the leading and trailing propeller coupled together showing timing marker 4.

FIG. 11 illustrates the leading and trailing propeller coupled together showing timing marker 4 and hub 1102.

Figure 12:
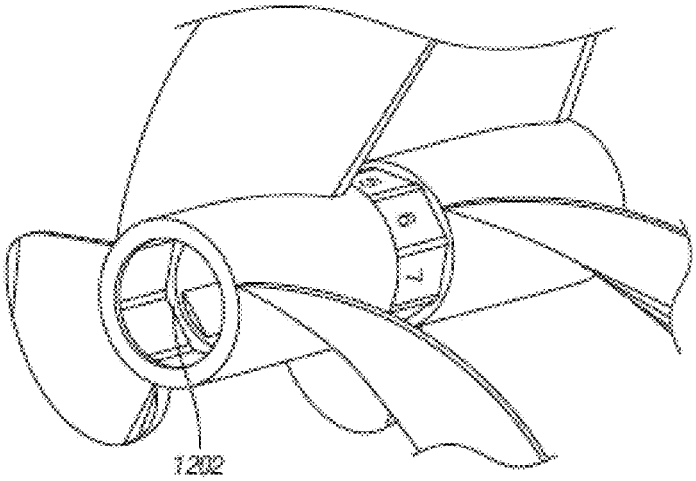
FIG. 12 illustrates an octagonal thrust washer seat where the propeller shaft inserts.

FIG. 12 illustrates an octagonal thrust washer seat where the propeller shaft inserts to form the entire assembly 1000.

Figure 13:
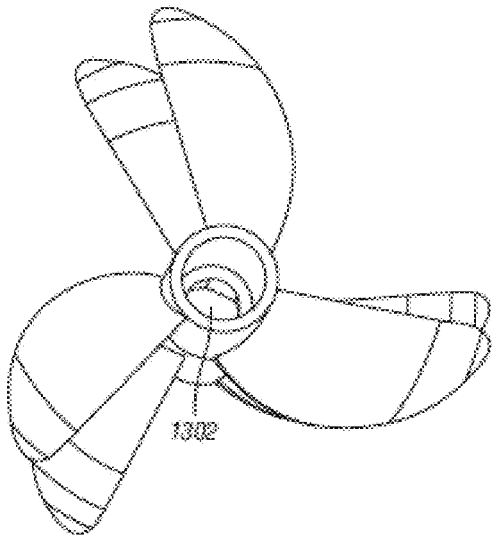
FIG. 13 illustrates an alternate bottom view of the propeller and hub showing the interior compartment for housing the locking propeller nut.

FIG. 13 illustrates an alternate bottom view of the propeller and hub showing the interior compartment 1302 for housing the locking propeller nut.

Figure 14:
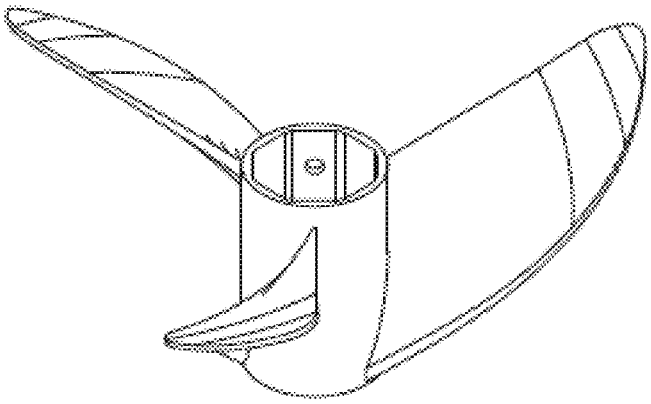
FIG. 14 illustrates the lead propeller and the octagonal interior housing and one timing hole.

FIG. 14 illustrates the lead propeller and the octagonal interior housing and one timing hole.

Figure 15:
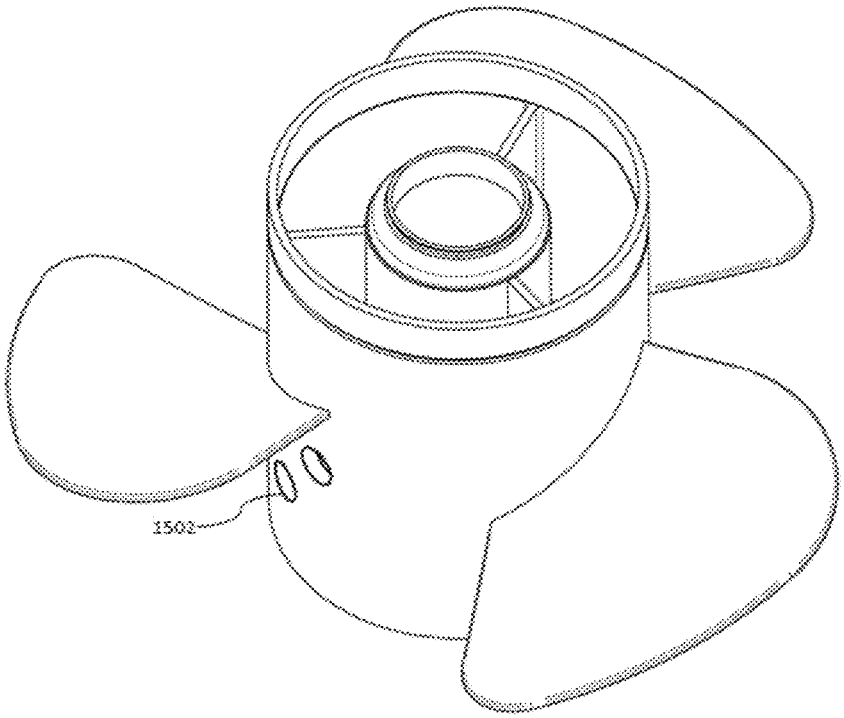
FIG. 15 illustrates a leading propeller with the barrel showing porting or vapor holes.

FIG. 15 illustrates a leading propeller having porting holes in the barrel. Porting or port holes can be placed on either embodiment described herein. The holes can be as few as 2 per blade or more, as desired by user, since an expense is made is having the holes machined into the hub. At a minimum the hub contains 2 holes for exhausting vapors.

Figure 16:
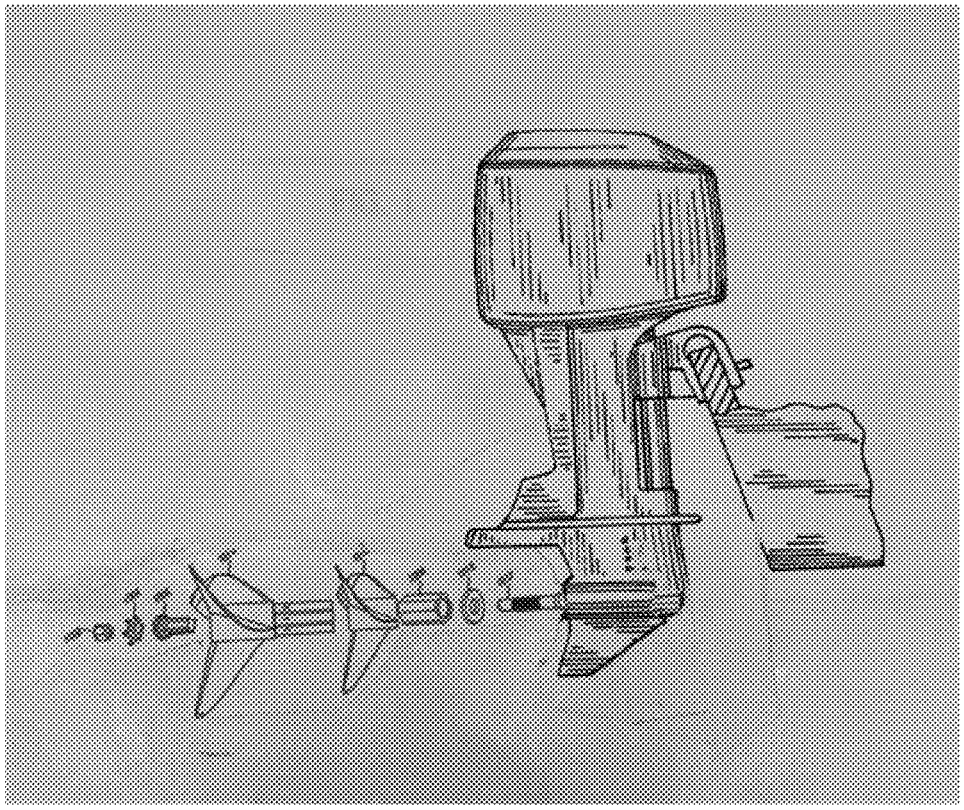
FIG. 16 illustrates a dual propeller assembly attached to a standard motorcraft engine.

FIG. 16 illustrates a dual propeller assembly attached is a standard motorcraft engine. The propeller assembly attaches to the engine via output shaft 1012 and locking nut 1002.

The assembly 1000 can be created as a kit for use by artisans. An output shaft on the assembly commonly known as a gear case will be used for description purposes. The kit is described for exemplary purposes having a flo-torque 2 hub kit. This kit fits smaller horse power motors below 300 hp. The kit can be assembled for engines with a horsepower of 5-400, preferably 50-400, more preferably 100-300, and most common and most preferred for horsepower engines of about 115-300.

Generally assembly of the unit involves and can be seen in conjunction with FIG. 10. Below is one method for assembly of the dual prop unit. It will be understood by those of skill in the art that various methods may be employed for piecing the parts together. The important portion being that the locking nut is tightly secured to the components through the propeller or output shaft:

1. Install the thrust washer onto the propeller shaft with the flat surface of the washer facing away from the gear case. The bevel of the washer should fit the cone shape on the output shaft.
2. The drive sleeve of the leading prop slides over the output shaft of the trailing prop with the adapter slots facing away from the gear case.
3. Install the trail prop into the lead prop creating the dual prop assembly. At this point, the two propellers are combined but still need additional components.
4. Slide the dual prop assembly described above, over the output shaft and onto the drive sleeve.
5. Slide the drive sleeve adapter over output shaft, and align the splines (markers found on FIG. 9B and FIG. 15) on the output shaft and slots on the drive sleeve, followed by sliding into place to rest firmly against trailing prop interior face.
6. Install the tab washer over the output shaft and against the drive sleeve adapter.
7. Install the locking nut onto the threads of the output shaft.
8. Bend tabs on the tab washer to lock the locking nut into place.
9. Tighten to manufacture's specifications.
10. Insert the dual assembly onto the motor through the output shaft, by rotating the propeller while the motor is in neutral to ensure no surfaces are binding.

A further alternate embodiment involves the assembly and installation as if someone is starting with and wishes to install the dual prop assembly on an outboard motor. The output shaft on the assembly known as gear case will be used for this assembly description with an emphasis on describing the assembly with the xz and xr flo-torque 2 heavy duty solid hub kit. This kit fits large outboards having 300 hp and over. Again, a kit can be prepared for motors greater than 300 hp and up to about 1200 hp, with a preference for 300-900 hp, and most preferably 300-400 hp. The type/size of kit will depend on the desired application (for example, use on an outdrive on a racing boat).

1. Install HD solid hub (HD=heavy duty) onto the output shaft with the thrust washer facing the gear case.
2. Insert the trail prop through the lead prop creating the dual prop assembly.
3. Install the dual prop assembly described above over the output shaft and slide it over the HD solid hub.
4. Optionally install washers according to manufactures instructions and install locking nut.
5. Torque the locking nut to manufacturer's specifications.
6. Insert the dual assembly onto the motor through the output shaft, by rotating the propeller while the motor is in neutral to ensure no surfaces are binding.

It has been found that the alternate design having no grooves, of the dual propeller results in a lighter weight assembly. It is easier to align the trailing and leading propeller with the alternate embodiment. The elimination of the grooves or teeth minimize the weight of the assembly, and alignment or timing markers make it easier to align the system. The lead propeller has at least one hole or window to show the marker number.

EXAMPLE

A turbo 1 Yamaha brand prop (the leading prop) was employed to align with the inventive trailing propeller. The trailing propeller slides directly over the radial flanges of the leading propeller adjusting evenly so as alignment of the hubs is intact. The propeller assembly was placed on a 21 foot boat and taken to water having 6" of depth to create a hole shot situation. It was found that the 21' boat while standing in 6" of water was able to move out of the water in ½ of the boat length.

Comparative: The same boat was in the hole shot with the standard turbo 1 Yamaha brand prop, and no trailing inventive propeller to form the assembly. The boat was not able to get on plane at all, or out of the water, and needed to drive in circles to get itself out of the hole shot. When compared to a high performance engine (hole shot prop) the distance to plane was 4 times as long in the above situation. In about 12" of water, this depth still considered shallow, the 21' test boat required more than a boat length to get on plane and needed to drive in circles to get out of the hole.

The propeller assembly 100 solves a poor hole shot problem without loss of speed and wears out slowly because of its efficiency. Although all cupping can be removed by wearing out of a propeller, the inventive propeller assembly 100 outperforms most of the modified propellers. It was seen that even though the propeller assembly 100 was completely worn out, it had a better hole shot than other modified propellers. Alternatively, when standard propellers exhibit little performance, it has been found that the present invention does not allow performance to suffer; both propellers can have significant wear and with the inventive prop, still perform better than a new or refurbished ("mint condition") standard propeller. The ability to couple the leading and trailing propellers 102 and 104 together improves hole shot with minimal to zero loss of speed. Further, the propeller assembly 100 design allows for the wearing out of the leading propeller 102 while protecting the wearing off of the trailing propeller 104. This allows a user to upgrade the performance of a propulsion system without replacing both the propellers. The propeller assembly 100 allows a boat to move out of shallow water in about a third to half the RPMS of its normal speed.

The leading propeller 102 and the trailing propeller 104 are coupled and aligned without welding. The propeller assembly 100 allows coupling of the leading and trailing propellers 102 and 104 in minimum time and eliminates potential misalignment from welding. The propeller assembly 100 can be used with both 4-stroke and 2-stroke motors. The leading and trailing propellers 102 and 104 do not counter-rotate.

While not wishing to be bound by theory, hole shot (thrust) is maximized by allowing water to remain on more blade surface (generally twice as many blades). The length of the propeller and number of blades maximizes the working force at hole shot. As speed increases, the turbulence of the leading propeller negates the efficiency of the trailing propeller. As propeller speed increases boat speed, the trailing prop idles along, synchronous to the leading propeller. This allows boats to achieve maximum speeds while delivering superior hole shot. Hole shot is increased between 60% to about 80% by adding, and correctly using, the present invention to an existing propeller.

It has been found that the present invention impacts steering of the boat and changes the steering from propeller driven to more jet-boat like driven. The handling and steering change once the inventive propeller assembly is installed and creates a safer operation, in particular a reduced blow-out during turns resulting from propeller ventilation often found on standard propeller systems. The reverse thrust is enhanced with the inventive propeller assembly and results in ease and improved stopping, especially important when the boat is near or around decks or docks.

Table 1 outlines the water depth and boat length found to get on plane, also known as moving out of the depth noted of water with a boat having the inventive propeller assembly. This shows the invention is directed to water less than 12" (inches) deep, or areas where the bottom of the water area is soft mud or clay. The boat reached plane within 3-10 seconds and usually between 3-5 seconds, and in some cases, almost instanteously. The examples for Table 1 were conducted with a 23 foot Shoal Water Cat Boat.

TABLE 1

| Water depth | out of hole shot |
|---|---|
| 0" (soft mud) | 1 boat length |
| 4" (soft mud) | 1 boat length |
| 6" (clay bottom) | ½ boat length |
| 12" (clay bottom) | ½ boat length |
| 14" (hard sand) | difficult to get out of; generally a boater will stay away from this condition because the hard sand destroys equipment. To get out often requires 180-360 degree spin of the boat and this is then not using the invention. |

It has been found that the speed performance is not lost as the inventive propeller assembly wears. Often with traditional propellers speed is impacted, and almost always reduced with use or wear and tear of the propellers. With the inventive assembly, when it was newly placed on the boat, the speed was about 58 miles per hour. It was found after about 200 hours of use, the speed with the inventive propeller assembly was 57 miles per hour. Comparatively, a Bravo 1, 4-blade propeller after about 50 hours of similar use, was running at a reduced maximum speed by 5-10 miles per hour.

The present invention can produce hole shot in 12" and usually 6" or less of water without a counter rotating propeller. It can be mechanically assembled without the need to weld or cast the unit, the front and trailing propellers can be interchanged, and the unit can be retrofitted on a standard outboard motor.

The various embodiments have been found to have repeated performance, can be easily tuned (especially with the use of the timing markers), and easily aligned. If using port holes on the barrel, this will be assist with performance when idling in deep water.

Testing of the embodiment having no grooves resulted in similar or same performance as the design with the grooves. However the design without the grooves can be made lighter weight, (22 lbs vs 10 lbs) and shorter (15" vs 10").

The present invention has been described herein with reference to a particular embodiment for a particular application. Although the selected embodiments have been illustrated and described in detail, it should be understood that various substitutions and alterations are possible. Those with ordinary skill in the art and access to the present teachings may realize that additional various substitutions and alterations are also possible without departing from the spirit and scope of the present invention, and as defined by the following claims.

What is claimed is:

1. A dual propeller assembly comprising a trailing propeller that is secured to a leading propeller, the trailing propeller further comprising:

a first cylindrical hub having a plurality of grooves on one end; a second cylindrical hub having a cylindrical mount ring, wherein the cylindrical mount ring is attached to the second cylindrical hub by a set of radial mount ring flanges; and a conical profile formed between the first cylindrical hub and the second cylindrical hub, wherein the trailing propeller is secured and aligned coaxially to the leading propeller byway of the plurality of grooves, the conical profile, and the cylindrical mount ring, an output shaft extending through the interior of the trailing and leading propeller and a locking nut forming the dual propeller assembly, said dual propeller assembly being capable of being attached to a watercraft engine wherein torque is transferred from the leading propeller to the trailing propeller, and the leading propeller and trailing propeller do not counter-rotate.

2. The trailing propeller of claim 1, wherein the first cylindrical hub is received in a hub of the leading propeller.

3. The trailing propeller of claim 2, wherein an outer diameter of the first cylindrical hub is selected based on an inner diameter of the hub of the leading propeller.

4. The trailing propeller of claim 1, wherein the plurality of grooves are spaced equidistant from each other.

5. The trailing propeller of claim 1, wherein the plurality of grooves rest on a corresponding plurality of radial flanges of the leading propeller.

6. The trailing propeller of claim 1, further comprising a plurality of blades that extend from a surface of the second cylindrical hub.

7. The trailing propeller of claim 1, wherein a drive sleeve is engaged with the cylindrical mount ring of the trailing propeller and the leading propeller.

8. The trailing propeller of claim 1, wherein a propeller shaft secures the trailing propeller with the leading propeller.

9. The trailing propeller of claim 1, wherein the trailing propeller is made of at least one of steel, stainless steel, carbon fiber, fiberglass, elastomeric polymer and aluminum.

10. The trailing propeller of claim 1 wherein the leading propeller and the trailing propeller are interchangeable.

11. A trailing propeller secured to a leading propeller, the trailing propeller comprising: a first cylindrical hub with a plurality of blades and an extended shaft portion, the shaft portion corresponding in shape to a mounting ring and hub of a leading propeller also having a plurality of blades, such that upon mating the leading propeller and trailing propeller form a dual propeller assembly, wherein further the trailing propeller is secured and aligned coaxially to the leading propeller by way of a lock nut, said dual propeller assembly being capable of being attached to a watercraft engine wherein torque is transferred from the trailing propeller to the leading propeller, and the leading propeller and trailing propeller do not counter-rotate.

12. The trailing propeller of claim 11 further comprising a propeller shaft secured to a drive sleeve with a thrust washer and further secured to the interior of the leading propeller.

13. The trailing propeller of claim 11 further comprising a sleeve adapter secured to the interior of the trailing propeller with a tab washer and a lock nut.

14. A dual propeller assembly comprising a leading propeller and a trailing propeller, wherein the leading propeller comprising: a cylindrical hub having an extended shaft portion on one end; a mounting ring attached to the opposite end of the cylindrical hub which accepts a locking nut; the trailing propeller comprising a cylindrical hub and having a drive sleeve engaged with a propeller shaft wherein the propeller shaft secures the leading propeller and the trailing propeller with the locking nut, said dual propeller assembly being capable of being attached to a watercraft engine wherein torque is transferred from the trailing propeller to the leading propeller, and the leading propeller and trailing propeller do not counter-rotate.

15. A dual propeller assembly comprising a trailing propeller that is secured to a leading propeller, the trailing propeller comprising a first cylindrical hub having a plurality of grooves on one end; a leading propeller designed to accept the plurality of grooves of the trailing propeller forming the dual propeller assembly, and the trailing and leading propeller secured together with a propeller shaft and locking nut which extends through the interior of the dual propeller assembly, said dual propeller assembly being capable of being attached to a watercraft engine wherein torque is transferred from the leading propeller to the trailing propeller, and the leading propeller and trailing propeller do not counter-rotate.

16. The assembly of claim 15 having port holes on the hub.

17. The assembly of claim 15 for use on a watercraft engine.

* * * * *